US007699723B2

(12) United States Patent
Herman

(10) Patent No.: US 7,699,723 B2
(45) Date of Patent: Apr. 20, 2010

(54) WEIGHTED STICK PRACTICE AID

(75) Inventor: Craig Herman, Pleasant Ridge, MI (US)

(73) Assignee: Warrior Sports, Inc., Warren, MI (US)

( * ) Notice: Subject to any disclaimer, the term of this patent is extended or adjusted under 35 U.S.C. 154(b) by 140 days.

(21) Appl. No.: 11/848,682

(22) Filed: Aug. 31, 2007

(65) Prior Publication Data

US 2008/0058130 A1 Mar. 6, 2008

Related U.S. Application Data

(60) Provisional application No. 60/824,369, filed on Sep. 1, 2006.

(51) Int. Cl.
*A63B 69/00* (2006.01)

(52) U.S. Cl. ..... 473/437; 473/513; 473/256

(58) Field of Classification Search ..... 473/505, 473/512, 513, 437, 256; D21/724
See application file for complete search history.

(56) References Cited

U.S. PATENT DOCUMENTS

| | | | | |
|---|---|---|---|---|
| 3,398,961 | A * | 8/1968 | Higdon | 473/242 |
| 3,490,768 | A * | 1/1970 | Archer | 473/213 |
| 3,508,748 | A | 4/1970 | Strimel | |
| 3,521,883 | A | 7/1970 | Hamilton | |
| 3,647,220 | A * | 3/1972 | Burkart et al. | 473/238 |
| 3,740,053 | A * | 6/1973 | Eiger | 473/206 |
| 4,247,101 | A * | 1/1981 | Gallmeyer | 473/63 |

(Continued)

FOREIGN PATENT DOCUMENTS

CA 2 330 797 7/2002

*Primary Examiner*—Gene Kim
*Assistant Examiner*—M Chambers
(74) *Attorney, Agent, or Firm*—Warner Norcross & Judd LLP

(57) ABSTRACT

A weighted stick practice aid is provided for use with a lacrosse stick assembly including a lacrosse stick, a lacrosse head having a head neck portion, a head ball stop portion, head sidewalls, and a head lip. The weighted stick practice aid comprises a flexible padded weight donut comprising a horizontal donut portion including a first engagement end, a second engagement end, and a weighted interior center portion. The weighted interior center portion includes a plurality of weighted particulates contained within. A head engagement portion extends from the second engagement end and includes a donut loop hole formed within. The horizontal donut portion is configured to wrap around the lacrosse stick and form a primary catch by engaging the first engagement end to the second engagement end. The head engagement portion is configured to extend to sit within the head ball stop portion. An anchor assembly comprises an arched rigid anchor element including an anchor outer portion having an outer width, an anchor inner portion having an inner width, and an anchor middle portion having a middle width smaller than said outer width or said inner width to form a pair of anchor connector grooves. An elastic anchor loop is secured to the arched rigid anchor element (through center) and is configured to be positioned between the lacrosse stick and the horizontal donut portion prior to the primary catch formation such that the elastic anchor loop protrudes through an upper donut edge and the arched rigid anchor element protrudes through a lower donut edge. The elastic anchor loop is configured to pass through the donut hole loop and be brought down to engage the anchor grooves to form a secondary catch.

17 Claims, 6 Drawing Sheets

U.S. PATENT DOCUMENTS

| | | | | |
|---|---|---|---|---|
| 4,371,983 | A | 2/1983 | Piotti | |
| 4,588,191 | A * | 5/1986 | Stewart | 473/256 |
| 4,846,464 | A * | 7/1989 | Jorno | 482/105 |
| 4,966,365 | A * | 10/1990 | Winston | 482/105 |
| 5,501,450 | A | 3/1996 | Nolan | |
| 6,056,173 | A * | 5/2000 | Gillespie | 224/247 |
| 7,128,667 | B2 | 10/2006 | Nolan | |
| 2004/0063519 | A1 * | 4/2004 | Liberatore | 473/457 |
| 2004/0176194 | A1 * | 9/2004 | Mitchell | 473/437 |
| 2008/0058130 | A1 * | 3/2008 | Herman | 473/513 |

* cited by examiner

WEIGHTED STICK PRACTICE AID

CROSS-REFERENCE TO RELATED APPLICATIONS

The present invention claims priority from U.S. Provisional Patent Application Ser. No. 60/824,369, filed Sep. 1, 2006 and entitled "Weighted Stick Practice Aid".

TECHNICAL FIELD

The present invention relates generally to a lacrosse practice aid and more particular to a lacrosse weighted stick practice aid.

BACKGROUND OF THE INVENTION

The sport of lacrosse has increased in popularity significantly over the years. Wherein it once had a limited range of collegiate clubs in the east coast, it now ranges throughout the United States and internationally. Lacrosse is a high speed and high energy game requiring significant player speed and agility. Players often spend considerable time and energy training to improve their speed and agility. In addition, player strength also plays a fundamental role in performance.

In sports such as baseball, it is known that weights in the form of rigid rings may be added to the bat to improve strength, act as a stretching routine, and improve agility. These rings are secured by the increasing dimension of a standard bat. Lacrosse sticks, however, typically utilize fairly uniform width sticks. Therefore the ability to add weight to a lacrosse stick requires a more complex solution. In order to add weight to a lacrosse stick, it must be adequately secured to avoid slippage or disconnect. In addition, lacrosse stick motion during practice involves a plurality of angles and speeds. Therefore, any added weight must be suitable for such motions. In addition, it is desirable for such added weight to be positioned in close proximity to optimize effect. The added momentum can be highly beneficial to a player's development. Since it is desirable for such a weight to be added to a player's existing stick, it is necessary that any such weight be easily installed and removed.

It would therefore be highly desirable to have a weighted stick practice aid that was simply and securedly attachable to a wide variety of lacrosse stick assemblies. It would further be highly desirable to have such a weighted stick practice aid that added weight to the lacrosse stick assembly in close proximity to the lacrosse head. Finally, it would be highly desirable for such a weighted aid to be simply and easily removable prior to use of the lacrosse stick assembly in play. This would allow an athlete to utilize the weight assembly to warm up and stretch prior to entering official play.

SUMMARY OF THE INVENTION

In accordance with the advantages of the present invention, a weighted stick practice aid is provided for use with a lacrosse stick assembly including a lacrosse stick, a lacrosse head having a head neck portion, a head ball stop portion, head sidewalls, and a head lip. The weighted stick practice aid includes a flexible padded weight donut comprising a horizontal donut portion including a first engagement end, a second engagement end, and a weighted interior center portion. The weighted interior center portion includes a plurality of weighted particulates or filler contained within. A head engagement portion extends from the second engagement end and includes a donut loop hole formed within. The horizontal donut portion is configured to wrap around the lacrosse stick and form a primary catch by engaging the first engagement end to the second engagement end. The head engagement portion is configured to extend to sit within the head ball stop portion. An anchor assembly comprises an arched rigid anchor element including an anchor outer portion having an outer width, an anchor inner portion having an inner width, and an anchor middle portion having a middle width smaller than the outer width or the inner width to form a pair of anchor connector grooves. An elastic anchor loop is secured to the arched rigid anchor element (through center) and is configured to be positioned between the lacrosse stick and the horizontal donut portion prior to the primary catch formation such that the elastic anchor loop protrudes through an upper donut edge and the arched rigid anchor element protrudes through a lower donut edge. The elastic anchor loop is configured to pass through the donut hole loop and be brought down to engage the anchor grooves to form a secondary catch.

Other advantages, objects and features of the present invention will become apparent when viewed in light of the detailed description and preferred embodiment when taken in conjunction with the attached drawings and claims.

DESCRIPTION OF PREFERRED EMBODIMENTS

Figure 1:
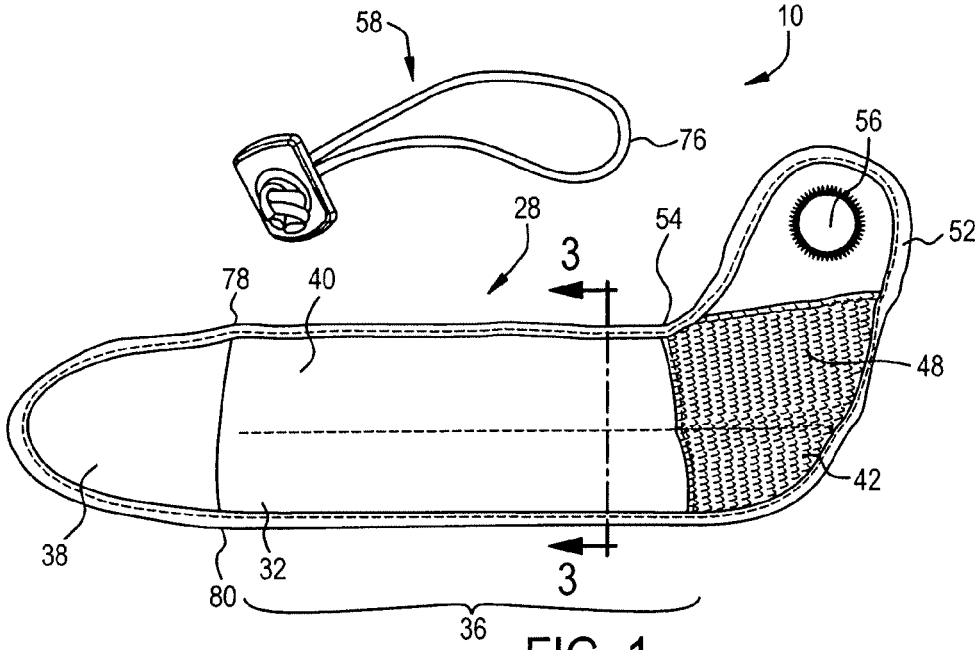
FIG. 1 is an illustration of a weighted stick practice aid in accordance with one embodiment of the present invention.
Figure 2:
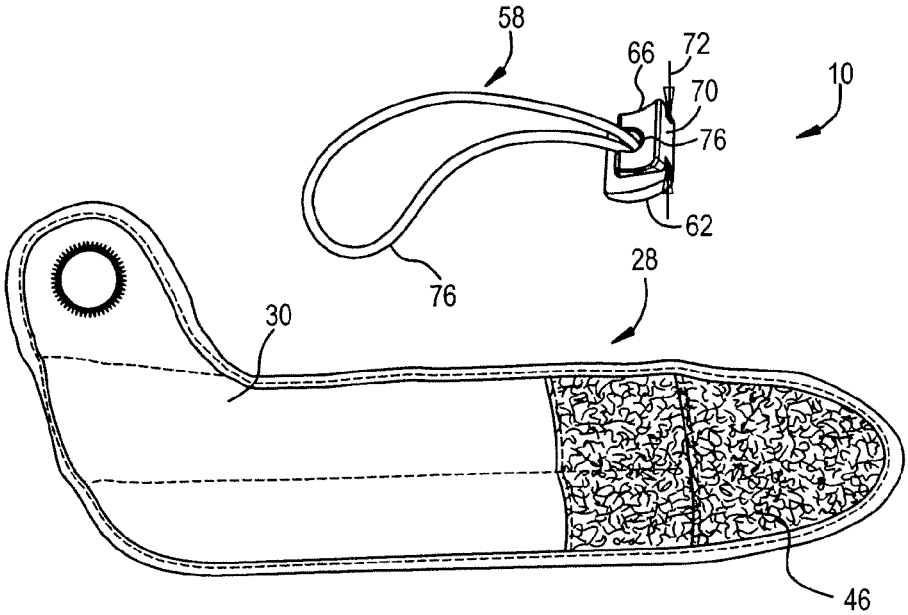
FIG. 2 is a rear view illustration of the weighted stick practice aid illustrated in FIG. 1.
Figure 6:
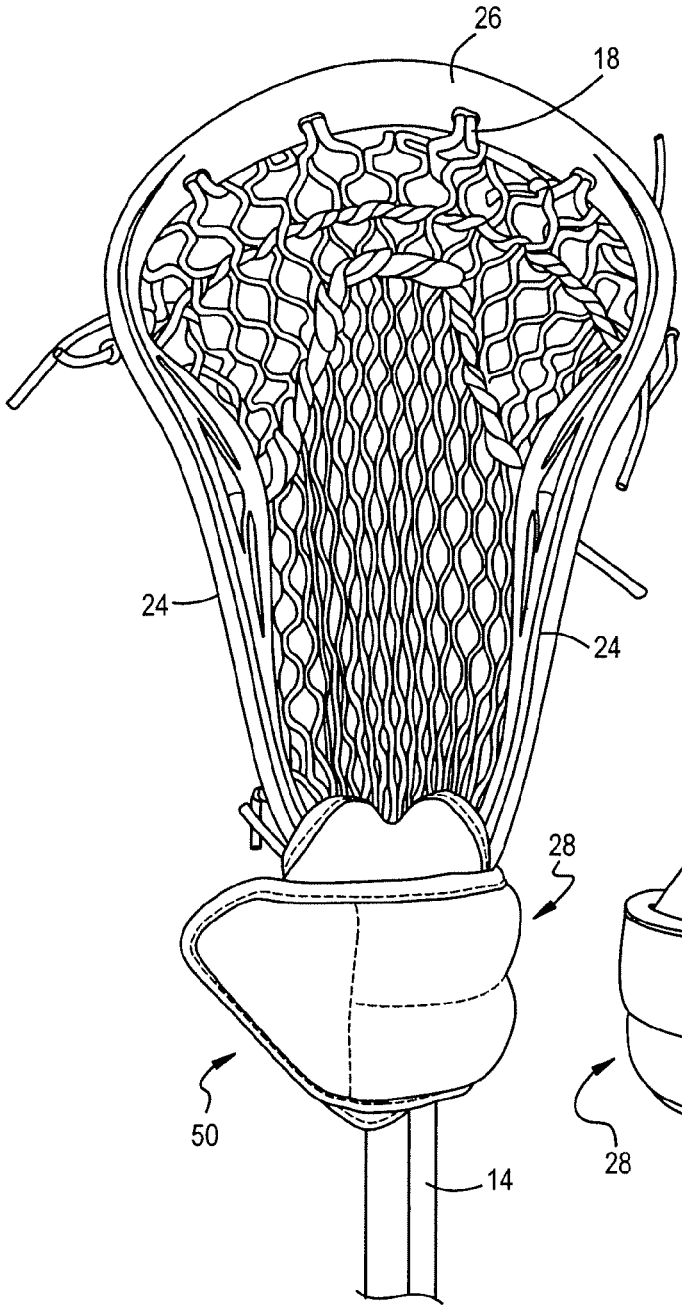
FIG. 6 is a front view illustration of the weighted stick practice aid illustrated in FIG. 1, the weighted stick practice aid shown mounted on a lacrosse stick assembly.
Figure 7:
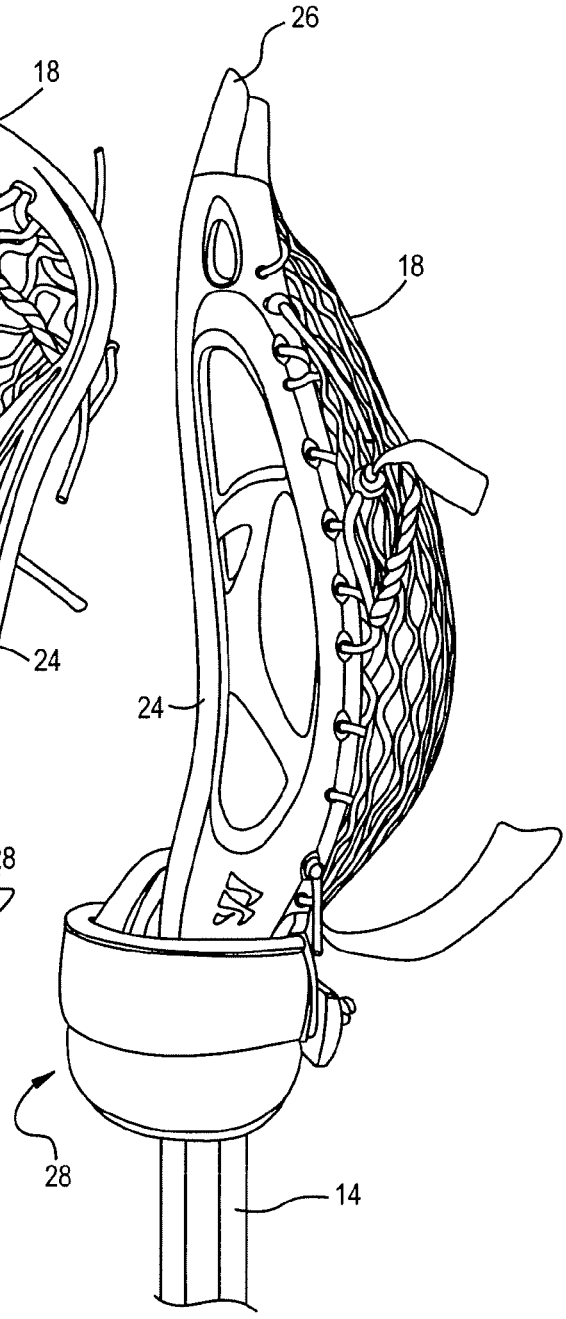
FIG. 7 is a first side view illustration of the assembly shown in FIG. 6.

Referring now to FIGS. 1 and 2, which are an illustration of a weighted stick practice aid 10 in accordance with one embodiment of the present invention. The weighted stick practice aid 10 is intended for use with a lacrosse stick assembly 12 (see FIG. 6). The lacrosse stick assembly 12 is generally comprised of a lacrosse stick 14, a lacrosse head 16, and a netting element 18 attached thereto. The lacrosse head 16 is typically comprised of a head neck portion 20, a head ball stop position 22, a pair of head sidewalls 24, and a head lip or scoop 26. The present invention provides a removable weight system for practice, stretching, or training that may be easily installed and removed to existing lacrosse stick assemblies 12 by a player.

Figure 3:
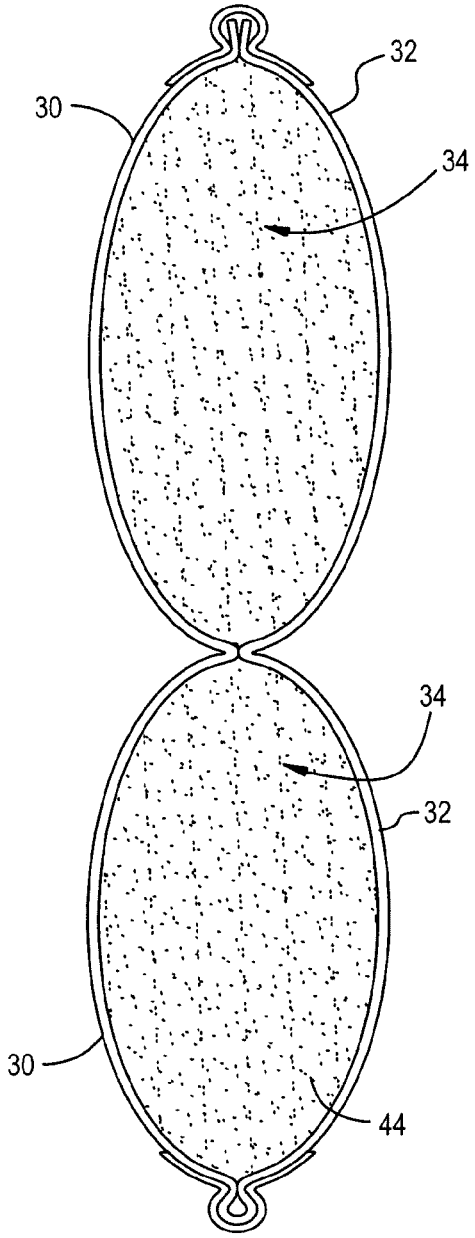
FIG. 3 is a cross-sectional illustration of the weighted stick practice aid illustrated in FIG. 1, the cross-section taken along the lines 3-3 in the direction of the arrows.
Figure 4:
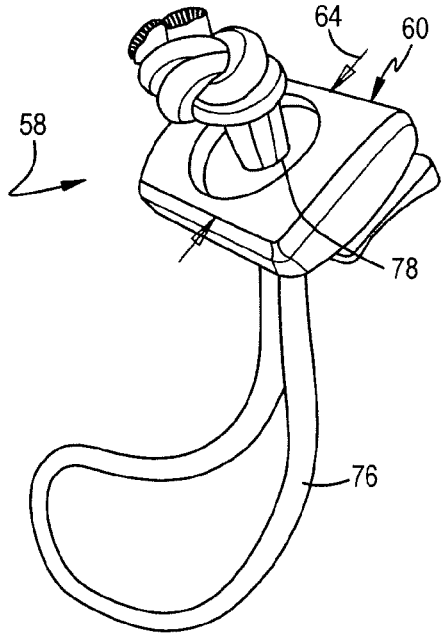
FIG. 4 is a detailed illustration of the anchor assembly illustrated in FIG. 1 in accordance with one embodiment of the present invention.
Figure 5:
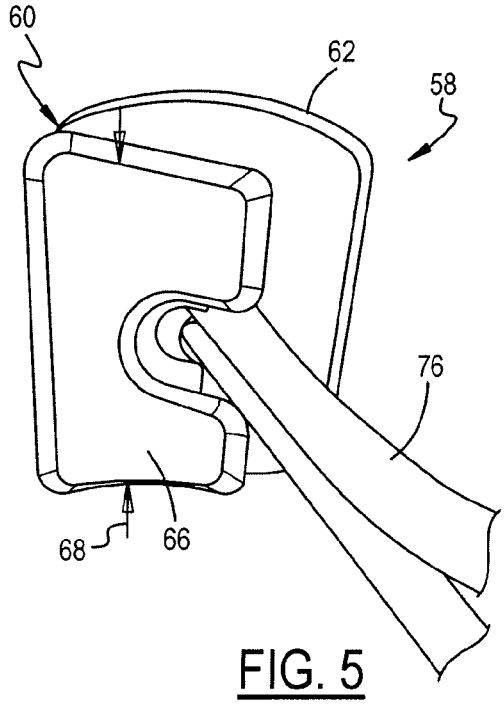
FIG. 5 is a rear view of the anchor assembly illustrated in FIG. 4.

The weighted stick practice aid 10 is comprised of a flexible padded weight donut 28 as illustrated in FIGS. 1 and 2. The flexible padded weight donut 28 is preferably a soft material inner surface 30 sewn to a soft material outer surface 32 encapsulating at least one weighted internal segment 34 (see FIG. 3). In one embodiment, the flexible padded weight donut 28 includes two weighted internal segments 34. The flexible padded weight donut 28 is comprised of a horizontal donut portion 36 having a first engagement end 38, a weighted interior center portion 40, and a second engagement end 42. Although the term horizontal is utilized, it should be understood that it is only intended to refer to a relative orientation for illustrative purposes. Although the weighted internal segments 34 may span any length of the horizontal donut portion, in one embodiment the weighted internal segments 34 run from the beginning of the weighted interior center portion 40 to the end of the second engagement end 42.

It should also be understood that the weighted internal segments 34 may be weighted in a variety of different fashions. Highly dense material may be inserted into segments 34. In addition, in one embodiment it is preferable that the highly dense material be flexible to allow the horizontal donut portion 36 to be wrapped around a lacrosse stick 14 or the head neck portion 20. In still another embodiment, the highly dense material may comprise a plurality of weighted particulates 44 such as sand or metal particles. However, a variety of other suitable weighted materials can be utilized as an infill. Although a variety of embodiments have been described, it should be understood that a plurality of modifications may become apparent in light of this disclosure.

The first engagement end 38 and the second engagement end 42 preferably include, respectively, a first engagement patch 46 affixed to the soft material inner surface 30 and a second engagement patch 48 affixed to the soft material outer surface 32. This allows the horizontal donut portion 36 to be wrapped around the lacrosse stick 14 or head neck portion 20 leaving the first engagement patch 46 to engage the second engagement patch 48 and thereby form a primary catch 50 (see FIG. 6).

Figure 8:
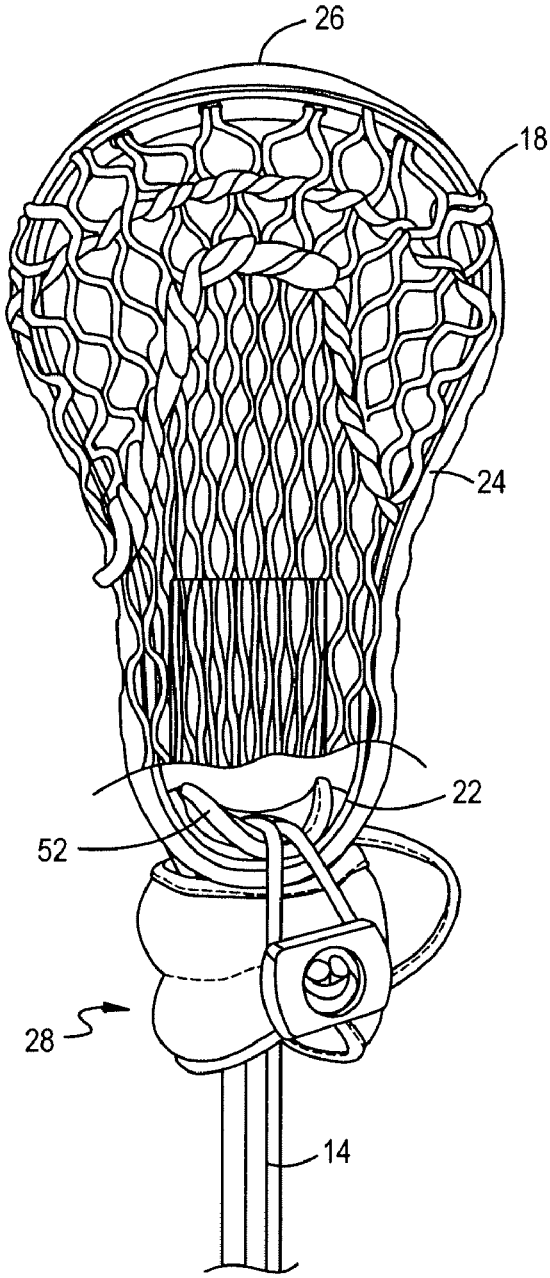
FIG. 8 is a rear view illustration of the assembly shown in FIG. 6.
Figure 9:
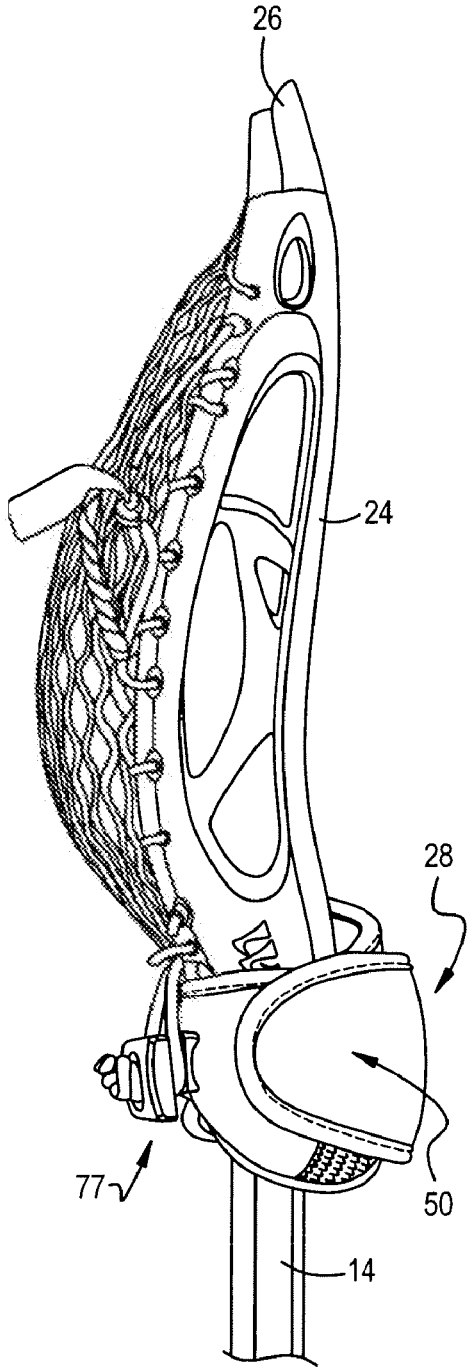
FIG. 9 is a second side view illustration of the assembly shown in FIG. 6.

The flexible padded weight donut 28 preferably additionally comprises a head engagement portion 52 that extends upwards from the horizontal donut portion 36. In one embodiment, it is contemplated that the head engagement portion 52 extends upward at approximately a 45 degree angle from an upper edge 54 of the second engagement end 42. The head engagement portion 52 includes a donut loop hole 56 (vertical engagement feature) formed therein. The donut loop hole 56 is preferably a reinforced hole. The head engagement portion 52 is configured such that when the horizontal donut portion 36 is wrapped around the lacrosse stick 14 or head neck portion 20 to form the primary catch 50, the head engagement portion 52 is configured to rest within the head ball stop portion 22 (see FIG. 8).

The present invention further includes an anchor assembly 58 (see FIGS. 1-2, 4-5). The anchor assembly 58 is configured to secure the head engagement portion 52 to the horizontal donut portion 36 through the lacrosse head 16 to secure the flexible padded weight donut 28 to the head neck portion 20 of the lacrosse head 16 (see FIGS. 6-9). Although a variety of embodiments are contemplated, in one embodiment the anchor assembly 58 includes an arched rigid anchor element 60 preferably formed of plastic by injection molding. The anchor element 60 is preferably arched so as to conform to the weighted internal segments 34 once assembled. The anchor element 60 includes an anchor outer portion 62 having an outer width 64, an anchor inner portion 66 having an inner width 68, and an anchor inner portion 70 having a middle width 72. The middle width 72 is preferably smaller than the outer width 64 or the inner width 68 such as to form a pair of anchor connector groves 74.

Figure 12:
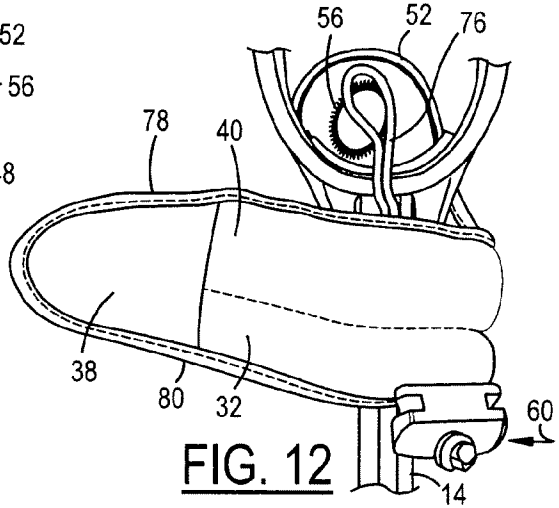
FIGS. 10-15 are a step by step illustration showing the method in which the weighted stick practice aid is mounted onto a lacrosse stick assembly in accordance with one embodiment of the present invention.
Figure 11:
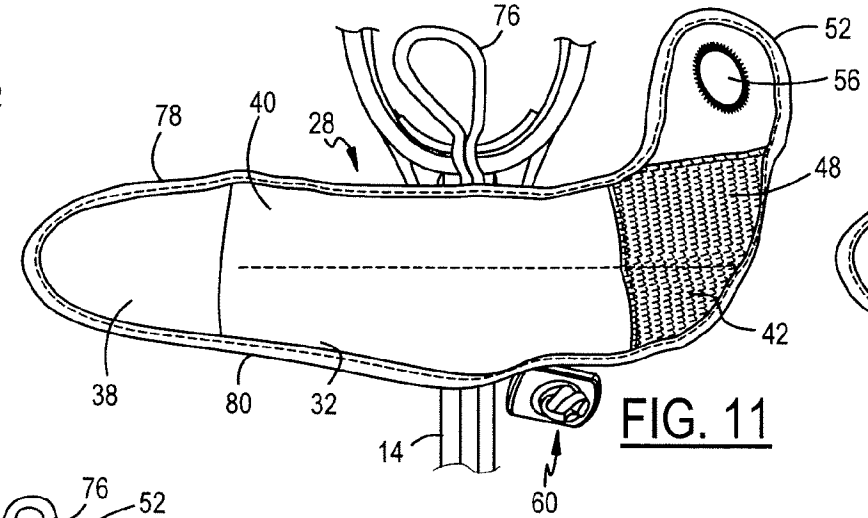
Figure 10:
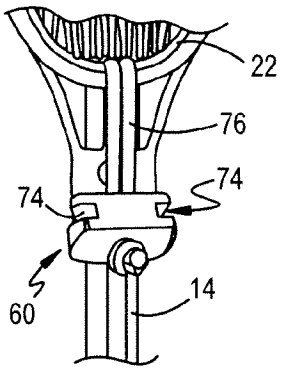
Figure 13:
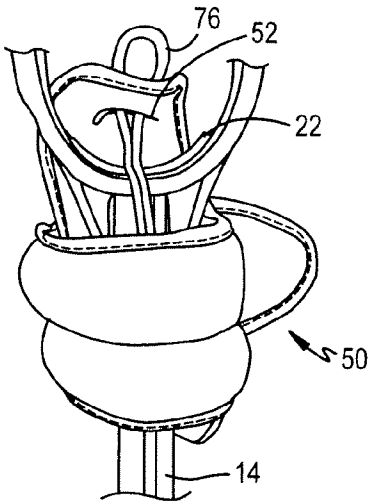
Figure 14:
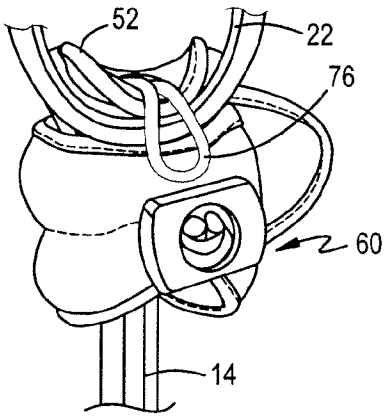
Figure 15:
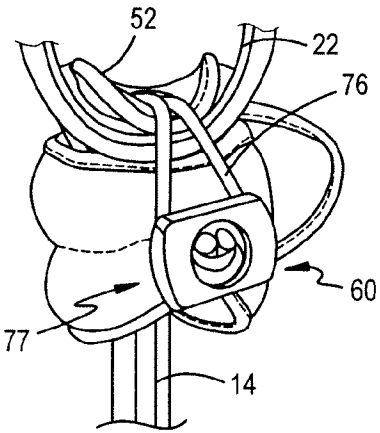
Figure 16:
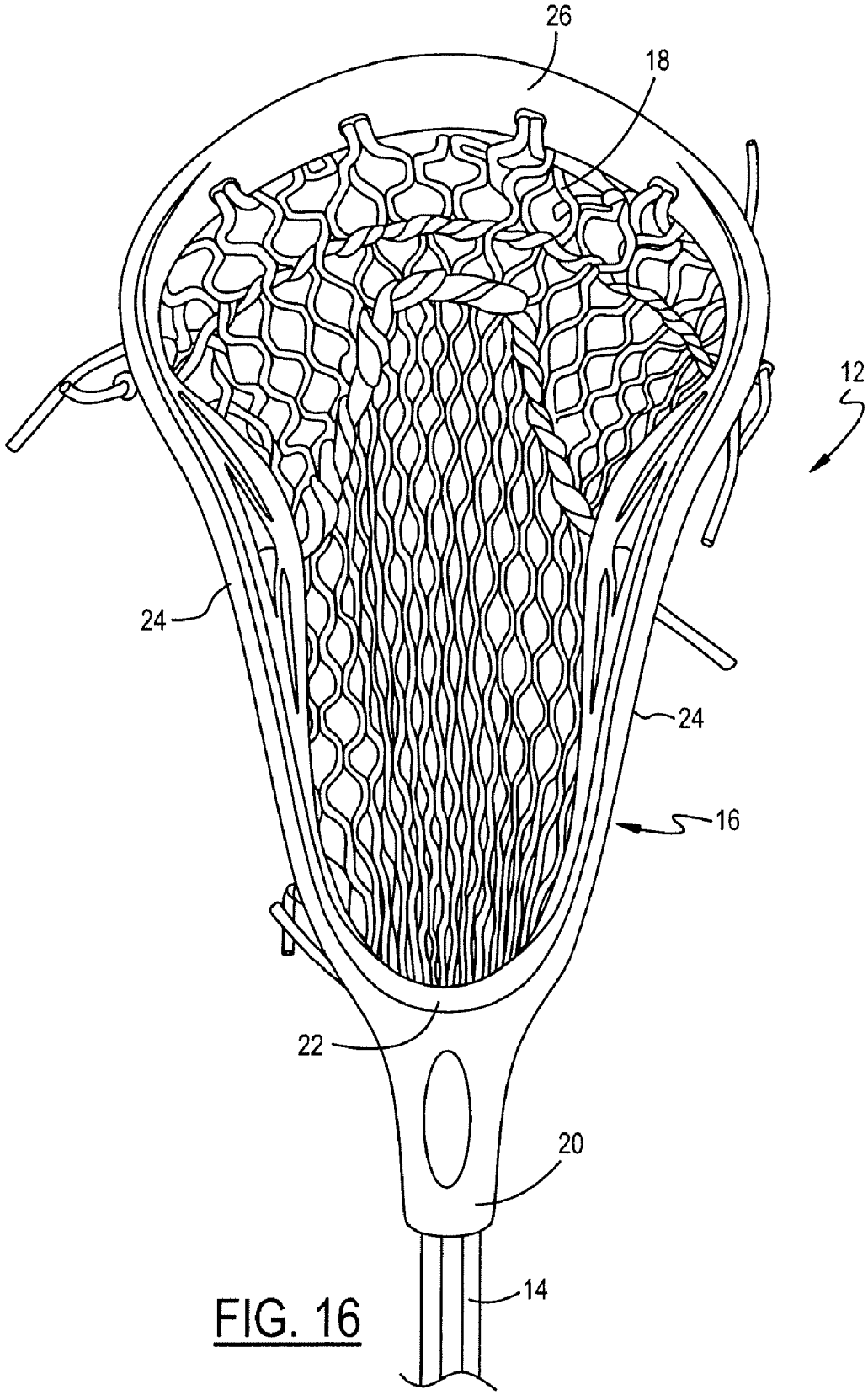
FIG. 16 is an illustration of a lacrosse stick assembly for reference in FIGS. 10-15.

The anchor assembly 58 further includes an elastic anchor loop 76 affixed to the rigid anchor element 60. In one embodiment, the elastic anchor loop 76 is passed through a center anchor bore 78 formed in the rigid anchor element 60 and is tied off. The anchor assembly 58 is placed along the lacrosse stick 14 and the lacrosse head 16 prior to affixing the horizontal donut portion 36 into the primary catch 50 (FIG. 10). In one embodiment, it is contemplated that the elastic anchor loop 76 will protrude from an upper horizontal donut edge 78 and the rigid anchor element 60 will protrude from a lower horizontal donut edge 80 (FIG. 11). The horizontal donut portion 36 is then wrapped around the lacrosse stick 14, and the primary catch 50 is secured (FIG. 12). The elastic anchor loop 76 is placed through the donut loop hole 56 of the head engagement portion 52 as it sits within the head ball stop portion 22 entering from a side of the lacrosse head 16 opposite the anchor assembly 58 (FIG. 13). The elastic anchor loop 76 is then stretched downwards to removably engage the rigid anchor element 60 (FIGS. 14-15). In this fashion, the anchor assembly 58 secures the flexible padded weight donut 27 to the lacrosse head 16 forming a secondary catch 77. In one embodiment, the elastic anchor loop engages the rigid anchor element 60 by being positioned within the anchor connector grooves 74. In other embodiments, however, a variety of attachment means are contemplated.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A weighted stick practice aid for use with a lacrosse stick assembly including a lacrosse stick, a lacrosse head having a head neck portion, a head ball stop portion, head sidewalls, and a head lip, the weighted stick practice aid comprising:

a flexible padded weight donut comprising:

a horizontal donut portion including a first engagement end, a second engagement end, and a weighted interior center portion; and a head engagement portion extended from said second engagement end, said head engagement portion including a donut loop hole formed within, said horizontal donut portion configured to wrap around the lacrosse stick and form a primary catch by engaging said first engagement end to said second engagement end, said head engagement portion configured to extend to sit within the head ball stop portion; and an anchor assembly comprising:

an rigid anchor element; and an elastic anchor loop secured to said rigid anchor element, said elastic anchor loop configured to be positioned between the lacrosse stick and the horizontal donut portion prior to said primary catch formation such that said elastic anchor loop protrudes through an upper donut edge and said rigid anchor element protrudes through a lower donut edge;

wherein said elastic anchor loop is configured to pass through said donut hole loop and be brought down to engage said rigid anchor element to form a secondary catch.

2. A weighted stick practice aid as described in claim 1, wherein said weighted interior center portion comprises a plurality of weighted particulates.

3. A weighted stick practice aid as described in claim 1, wherein said rigid anchor element comprises an arched rigid anchor element.

4. A weighted stick practice aid as described in claim 1, wherein said elastic anchor loop is secured to said rigid anchor element by way of passing through a center anchor bore formed in said rigid anchor element.

5. A weighted stick practice aid as described in claim 1, wherein said rigid anchor element comprises:

an anchor outer portion having an outer width;

an anchor inner portion having an inner width; and an anchor middle portion having a middle width smaller than said outer width or said inner width to form a pair of anchor connector grooves;

wherein said elastic anchor loop is configured to pass through said donut hole loop and be brought down to engage said anchor connector grooves to form said secondary catch.

6. A weighted stick practice aid as described in claim 1, wherein said weighted interior center portion comprises a pair of weighted internal segments.

7. A weighted stick practice aid as described in claim 1, wherein said flexible padded weight donut comprises:

a soft material inner surface;

a soft material outer surface sewn to said soft material inner surface and encapsulating at least one weighted internal segment.

8. A weighted stick practice aid as described in claim 1, wherein said weighted interior center portion comprises a highly dense flexible material.

9. A weighted stick practice aid as described in claim 7, further comprising:

a first engagement patch affixed to said soft material inner surface; and a second engagement patch affixed to said soft material outer surface.

10. A weighted stick practice aid as described in claim 1, wherein said first engagement end engages said second engagement end using Velcro.

11. A weighted stick practice aid as described in claim 1, wherein said head engagement portion extends from said horizontal donut portion at an approximately 45 degree angle.

12. A weighted stick practice aid for use with a lacrosse stick assembly including a lacrosse stick, a lacrosse head having a head neck portion, a head ball stop portion, head sidewalls, and a head lip, the weighted stick practice aid comprising:

a flexible padded weight donut comprising:

a horizontal donut portion including a first engagement end, a second engagement end, and a weighted interior center portion, said horizontal donut portion configured to wrap around the lacrosse stick and form a primary catch by engaging said first engagement end to said second engagement end; and a head engagement portion extended from said second engagement end, said head engagement portion including a vertical engagement feature formed within; and an anchor assembly configured to vertically secure said vertical engagement feature to the lacrosse head, wherein said anchor assembly comprises:

a rigid anchor; and an elastic anchor loop secured to said rigid anchor element, said elastic anchor loop extending around at least a portion of the horizontal donut portion and protruding through a donut edge, wherein said elastic anchor loop is configured to engage said vertical engagement feature and configured to removably engage said rigid anchor element to form a secondary catch.

13. A weighted stick practice aid as described in claim 12, wherein said head engagement portion is configured to sit within the head ball stop portion.

14. A weighted stick practice aid as described in claim 12, wherein said vertical engagement feature comprises a donut hole loop.

15. A weighted stick practice aid as described in claim 12, wherein said rigid anchor element comprises an arched rigid anchor element.

16. A weighted stick practice aid as described in claim 12, wherein said rigid anchor element comprises:

an anchor outer portion having an outer width;

an anchor inner portion having an inner width; and an anchor middle portion having a middle width smaller than said outer width or said inner width to form a pair of anchor connector grooves;

wherein said elastic anchor loop is configured to pass through said vertical engagement feature and be brought down to engage said anchor connector grooves to form said secondary catch.

17. A weighted stick practice aid as described in claim 12, wherein said head engagement portion extends from said horizontal donut portion at an approximately 45 degree angle.

* * * * *